US006293751B1

(12) United States Patent
Stockstill

(10) Patent No.: US 6,293,751 B1
(45) Date of Patent: Sep. 25, 2001

(54) WATER/SOLIDS EXTRACTING BLOWER

(76) Inventor: Virgil W. Stockstill, 707 N. Drennan, Houston, TX (US) 77003

( * ) Notice: Subject to any disclaimer, the term of this patent is extended or adjusted under 35 U.S.C. 154(b) by 0 days.

(21) Appl. No.: 09/421,840

(22) Filed: Oct. 20, 1999

Related U.S. Application Data

(60) Provisional application No. 60/131,918, filed on Apr. 30, 1999.

(51) Int. Cl.[7] ..... F04D 17/08

(52) U.S. Cl. ..... 415/1; 415/169.2; 415/173.1; 415/211.1; 55/406; 55/407; 55/413; 95/270

(58) Field of Search ..... 415/1, 169.2, 173.1, 415/211.1; 55/406, 407, 413; 95/270

(56) References Cited

U.S. PATENT DOCUMENTS

| | | | | |
|---|---|---|---|---|
| 1,274,058 | | 7/1918 | Kutsche . | |
| 1,785,918 | * | 12/1930 | Stebbins | 55/406 |
| 1,815,529 | * | 7/1931 | Shurtleff | 415/173.1 |
| 2,209,607 | * | 7/1940 | Nutting | 55/407 |
| 2,593,294 | * | 4/1952 | Goldberg | 55/406 |
| 2,780,309 | * | 2/1957 | Loftheim | 55/407 |
| 3,827,482 | * | 8/1974 | Pope | 415/211.1 |
| 3,942,500 | * | 3/1976 | Koehm et al. | 415/211.1 |
| 4,361,490 | | 11/1982 | Saget . | |
| 4,382,804 | | 5/1983 | Mellor . | |
| 4,468,234 | | 8/1984 | McNicholas . | |
| 4,832,709 | | 5/1989 | Magysalanczy . | |
| 4,877,424 | | 10/1989 | Perkola . | |
| 5,000,769 | | 3/1991 | Raguideau . | |
| 5,766,315 | | 6/1998 | Moredock . | |

FOREIGN PATENT DOCUMENTS

| | | | | |
|---|---|---|---|---|
| 687031 | * | 2/1953 | (GB) | 55/407 |
| 62-276297 | * | 12/1987 | (JP) | 415/173.1 |
| 348214 | * | 9/1972 | (SU) | 55/407 |

* cited by examiner

*Primary Examiner*—Christopher Verdier
(74) *Attorney, Agent, or Firm*—Keeling Law Firm

(57) ABSTRACT

An extracting blower that removes liquid and solid contaminants from supply air, and provides high velocity air for cooling equipment, personnel and/or structures. The blower uses air velocity and the centrifugal force of a rotating fan to separate the contaminants into a rear partitioned chamber of the fan housing and out a rear scavenging air exhaust, while blowing clean air out the main air blower.

4 Claims, 3 Drawing Sheets

WATER/SOLIDS EXTRACTING BLOWER

CROSS-REFERENCE TO RELATED APPLICATIONS

This application claims the benefit of U. S. Provisional Application No. 60/131,918, filed Apr.30, 1999.

STATEMENT REGARDING FEDERALLY SPONSORED RESEARCH OR DEVELOPMENT

Not applicable.

BACKGROUND OF THE INVENTION

1. Field of the Invention

This invention relates generally to extracting blowers. Specifically, this invention relates to extracting blowers that intake atmospheric air including liquid and solid particles and that separate the liquid and solid particles from the atmospheric air thereby generating clean air.

2. Description of the Related Art

Blowers for cooling and ventilation are well known in the industry. However, environmental air contaminants, such as airborne dust, water and other liquid vapors, and other light matter create a problem for blowers and their use. The contaminants become trapped in the blower itself, creating a build-up or sludge, which diminishes the effectiveness and useful life of the blower. Of greater significance, blowers that are unable to clean the air from these contaminants will pass them through and blow them on the area being cooled. Often, this area includes equipment that is sensitive to such contaminants, such as electrical equipment, rotating equipment and other structures and machines. It would therefore be a useful improvement on industrial blowers to include an improved design to remove such contaminants.

Prior art includes several designs for blowers that scrub blown air. However, many of these blowers rely on gravity to assist in the separation of the contaminants from the air, and therefore are only effective in removing larger contaminant particles. Other blowers use a complex system of baffles, filters, secondary pressure pumps or fully enclosed housings, which are difficult to maintain, clean and operate. It would therefore be a useful improvement to blower fans for the design to remove dust and liquid contaminants from the intake air while using relatively few moving parts and having convenient internal access for case in maintenance and operation.

BRIEF SUMMARY OF THE INVENTION

Air blowers are used in a variety of industries to provide cooling air to personnel, structures and equipment. Oftentimes, the air supply for these air blowers is contaminated with solids (e.g., dirt, grease, metallic and non-metallic dust) and/or liquids (e.g., water, organic and inorganic chemical vapors). These contaminants in the air being blown can damage equipment by compromising electrical circuits, reducing the efficiency of rotating equipment and decreasing the life of the equipment due to increased friction, corrosion and abrasion between moving parts.

Accordingly, the objectives of this invention are to provide, inter alia, an air blower that:

- mechanically removes solid and liquid contaminants from a local air supply;
- provides clean and dry forced air of sufficient velocity, quantity and pressure for cooling purposes; and
- has a low maintenance requirement due to simple design and minimal moving parts.

DETAILED DESCRIPTION OF THE INVENTION

Figure 2:
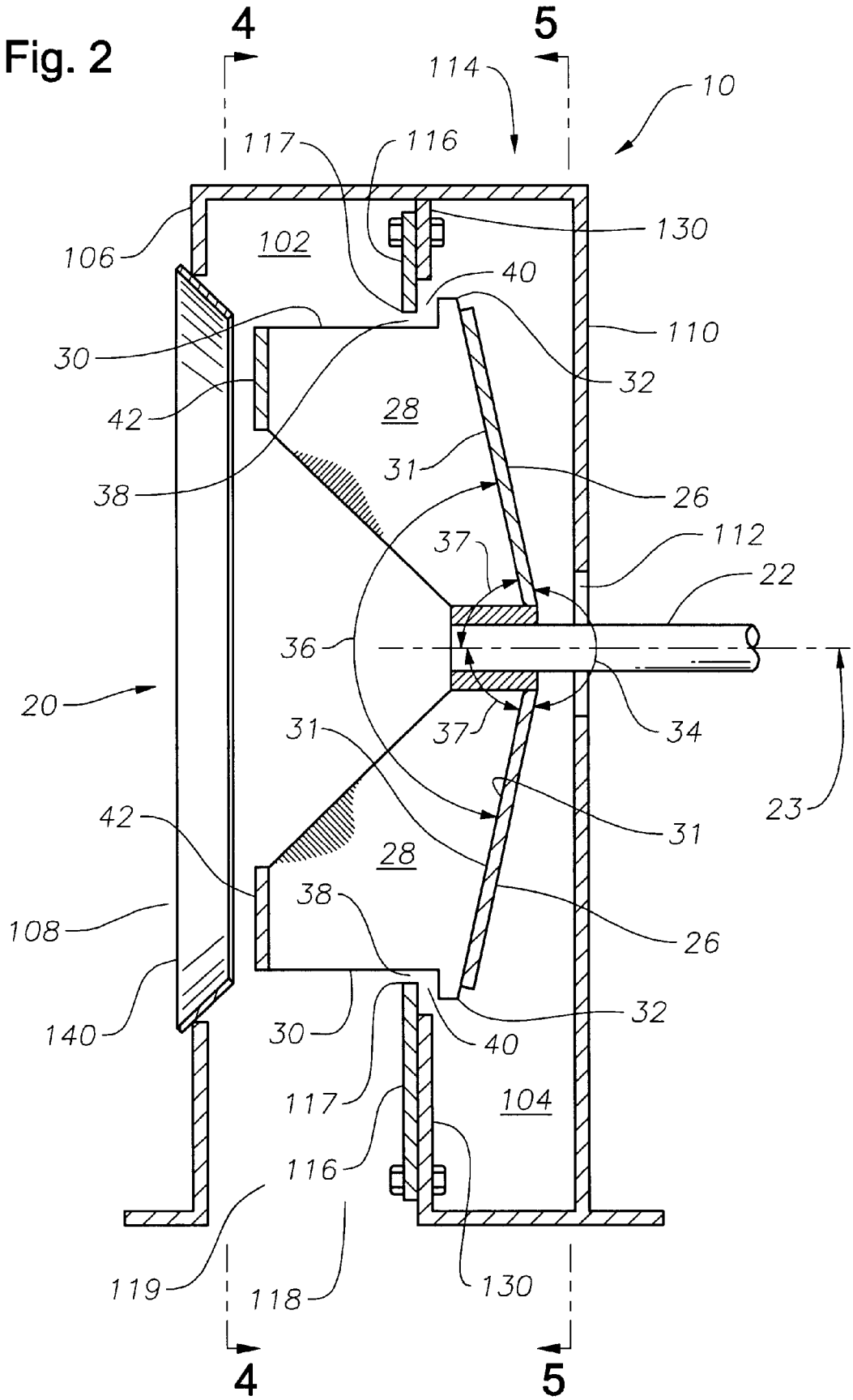
FIG. 2 is a cross-sectional view taken along line 3—3 of FIG. 1, including one embodiment of the fan and including the annular baffle.

The Extracting Blower is generally shown in FIGS. 1–6 as 10. Extracting blower 10 generally comprises a fan 20 that rotates within housing 100. As depicted in FIG. 2, housing 100 is divided into a front chamber 102 and a rear chamber 104. Fan 20 includes a conical shaped back plate 26 and a plurality of fan blades 28 extending therefrom. Back plate 26 has a back plate front side 31. Fan blades 28 extend partially within front chamber 102 and partially within rear chamber 104. Back plate 26 constitutes a barrier between front chamber 102 and rear chamber 104 while permitting a degree of fluid communication between front chamber 102 and rear chamber 104.

In short, air including liquids and solids (hereinafter referred to as "Dirty Air") enters housing 100 through air intake opening 108 and hits rotating fan 20. The liquids and solids of the Dirty Air strike the back plate 26, and due to the centrifugal force generated by the rotating fan 20, migrate outward along the back plate 26 together with a small regulated amount of air. Fan 20 and housing 100 are constructed so that only such migrating liquids, solids, and small regulated amount of air pass into rear chamber 104 and out of rear chamber 104 through a rear chamber contaminant exhaust outlet 120. The remainder of the air does not pass into rear chamber 104 and is instead forced out of front chamber 102 through a front chamber clean air outlet 118. Thus, the liquid and solid particles are separated from the Dirty Air, and air excluding at least some of the liquid and solid particles (hereinafter referred to as "Clean Air") flows through front chamber clean air outlet 118.

Housing 100, as previously disclosed, includes a front chamber 102 and a rear chamber 104. In the preferred embodiment, housing 100 has a generally cylindrical shape and includes a front wall 106, a rear wall 110, and a side wall 114. Front wall 106 and rear wall 110 generally correspond to the circular ends of the cylindrical shape, and side wall 114 generally corresponds to the height of the cylindrical shape. Alternatively, front wall 106 defines a partial convex shape.

Front wall 106 includes an air intake opening 108 through which Dirty Air flows into housing 100. Preferably, air intake opening 108 is concentrically located on front wall 106. Rear wall 110 includes a rotor drive shaft opening 112 through which the rotor drive shaft 22 of fan 20 extends into housing 100. Preferably, rotor drive shaft opening 112 is concentrically located on rear wall 110.

In its interior, housing 100 also includes a chamber partition 116 preferably fixedly attached to side wall 114. In the preferred embodiment, chamber partition 116 is substantially parallel to rear wall 110. Chamber partition 116 includes a partition opening 117, which is generally circular in the preferred embodiment, through which the fan 20 extends. Preferably, partition opening 117 has an opening center concentrically located on chamber partition 116 and is also concentric with rotor drive shaft opening 112.

In the preferred embodiment, front chamber 102 is defined by front wall 106, side wall 114, and chamber partition 116. In the preferred embodiment, rear chamber 104 is defined by rear wall 110, side wall 114, and chamber partition 116.

Front chamber 102 also includes a front chamber clean air outlet 118 which provides fluid communication between front chamber 102 and the exterior of housing 100. Front chamber clean air outlet 118 preferably comprises a first passage 119 providing fluid communication between front chamber 102 and the exterior of housing 100.

Rear chamber 104 also includes a rear chamber contaminant exhaust outlet 120 which provides fluid communication between rear chamber 104 and the exterior of housing 100. Rear chamber contaminant exhaust outlet 120 preferably comprises a second passage 121 providing fluid communication between rear chamber 104 and the exterior of housing 100.

In the embodiment shown in the Figures, housing 100 includes a tangential section 130. Tangential section 130 continues the division of housing 100 between front chamber 102 and rear chamber 104. Chamber partition 116 extends within tangential section 130 enabling such division within tangential section 130. In one embodiment, front chamber clean air outlet 118 and rear chamber contaminant exhaust outlet 120 are located on tangential section 130. It is understood, however, that extracting blower 10 does not require a tangential section 130 to function. Although not shown in the Figures, extracting blower 10 would be functional if side wall 114 was completely circular (not including tangential section 130) and front chamber clean air outlet 118 and rear chamber contaminant exhaust outlet 120 were located directly on side wall 114.

Fan 20 includes a conical shaped back plate 26 and a plurality of fan blades 28 extending therefrom, as previously disclosed, as well as a rotor drive shaft 22, which is aligned along fan axis 23, which is generally perpendicular to rear wall 110. Rotor drive shaft 22 extends through the rotor drive shaft opening 112 of rear wall 110 into rear chamber 104. Exterior to housing 100, rotor drive shaft 22 is functionally attached to a motor 200 which generates the rotation of rotor drive shaft 22. Motor 200 may be an electric motor, an internal combustion engine, a steam engine, a gas turbine or any other mechanical device known in the field for producing rotational power through a rotor drive shaft. In the preferred embodiment, motor 200 is an electric motor.

Conical shaped back plate 26 is fixedly, and preferably concentrically, attached to rotor drive shaft 22. In addition, back plate 26 is located within rear chamber 104 and is situated therein so that the reflex angle 34 defined by back plate 26 is proximate rear wall 110 and so that the obtuse angle 36 defined by back plate 26 is proximate chamber partition 116. Obtuse angle 36 preferably measures between 140 and 160 degrees (70°–80° measured between fan axis 23 and back plate 26). Back plate 26 is rotatable about fan axis 23, thus obtuse angle 36 can be described as the sum of acute angles 37, defined between back plate 26 and fan axis 23. In the preferred embodiment, obtuse angle 36 measures 150 degrees (75° measured between fan axis 23 and back plate 26). The outer cross-sectional diameter of back plate 26 is slightly larger than the cross-sectional diameter of the partition opening 117 of chamber partition 116 so that a portion of back plate 26 overhangs chamber partition 116.

The plurality of fan blades 28 are fixedly attached to back plate 26, on the side of back plate 26 including obtuse angle 36. Each fan blade 28 extends from back plate 26 within rear chamber 104 through the partition opening 117 of chamber partition 116 and into front chamber 102. Each fan blade 28 includes an outer edge 30 adjacent chamber partition 116. As shown in FIG. 2, chamber partition 116 and each fan blade 28 are constructed so that a first small gap 38 is defined between each fan blade outer edge 30 and chamber partition 116 (as the perpendicular distance therebetween). First small gap 38 is uniform throughout the entire circumference of partition opening 117. After experimentation, it has been discovered that an acceptable size for first small gap 38 is ¼ inch, although other sizes (smaller or larger) would also function.

A second small gap 40 is defined between each fan blade 28 and the side of chamber partition 116 facing rear wall 110. In one embodiment as shown in FIG. 2, each fan blade 28 includes a lip 32 on its outer edge 30 adjacent back plate 26. Lip 32 defines a larger fan diameter within rear chamber 104 than the smaller fan diameter defined by fan edge 30 in front chamber 102. Each lip 32 must be located within rear chamber 104 (between chamber partition 116 and back plate 26) and extends radially outward so that it overhangs chamber partition 116. Second small gap 40 is in this embodiment defined between each lip 32 and chamber partition 116 (as the perpendicular distance therebetween). Second small gap 40 is preferably uniform throughout the circumference of chamber partition 116. After experimentation, it has been discovered that an acceptable size for second small gap 40 is ¼ inch, although other sizes (smaller or larger) would also function.

Although the fan blades 28 shown in the FIG. 2 extend in a direction perpendicular to the back plate 26, it is understood that the fan blades 28 could extend in any angular direction from back plate 26 and still be within the scope of this invention in all embodiments. In addition, although the fan blades 28 shown in the Figures extend in a linear radial direction from the center of back plate 26, it is understood that the fan blades 28 could extend in any curved or arced radial direction from the center of back plate 26 and still be within the scope of this invention in all embodiments. Moreover, although the fan blades 28 shown in the Figures have a cross-sectional shape that is generally triangular (see FIGS. 2 and 3), it is understood that the fan blades 28 could be any cross-sectional shape and still be within the scope of this invention.

Figure 3:
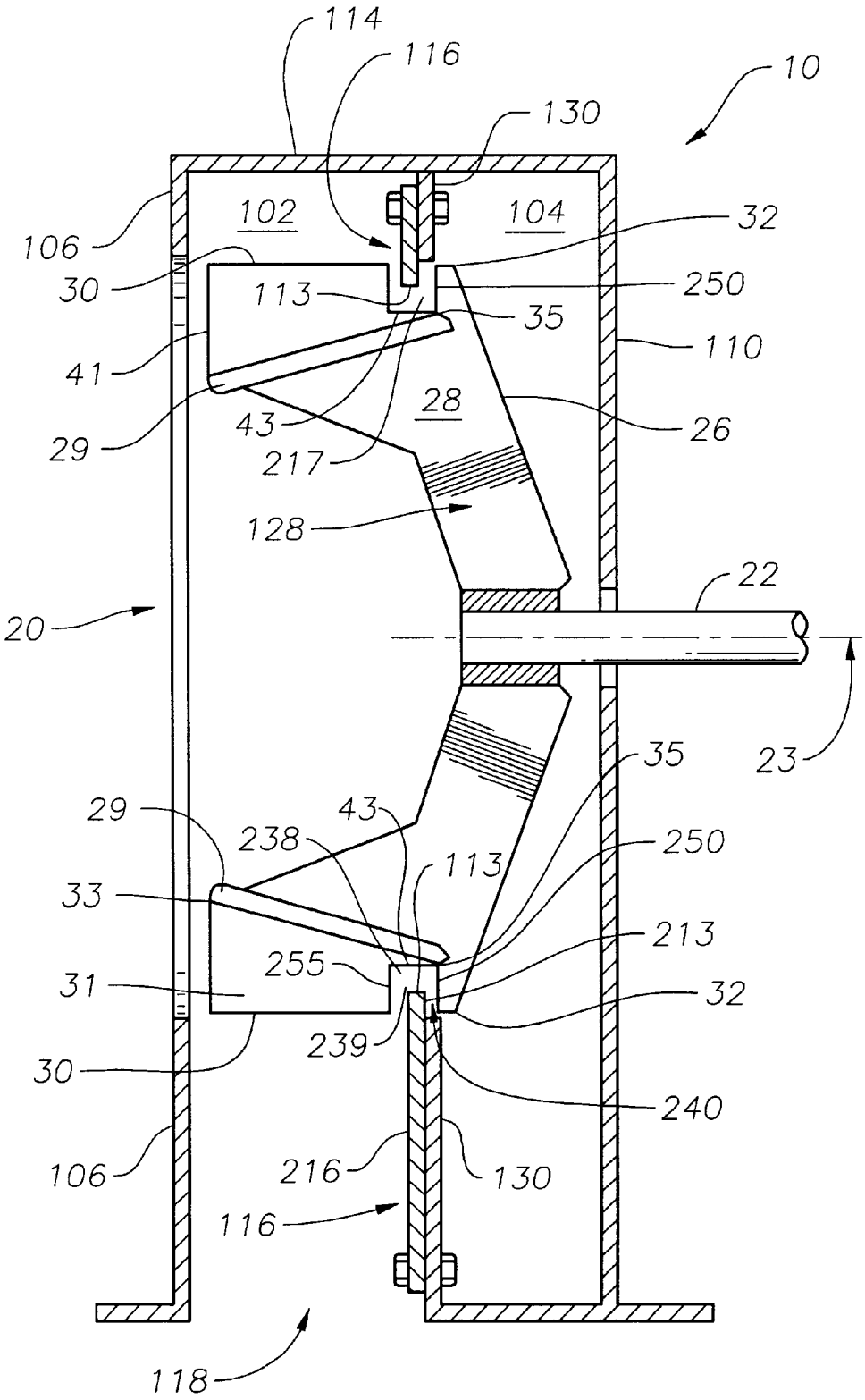
FIG. 3 is a cross-sectional view taken along line 3—3 of FIG. 1, including a preferred embodiment of the fan.

In the preferred embodiment shown in FIG. 3, fan blades 28 extend radially outward until outer edge 30 and lip 32 are radially equidistant from rotor drive shaft 22. In the preferred embodiment, fan blade notch 217 in fan blades 28 afford fluid communication between front chamber 102 and rear chamber 104, and are defined by first small gaps 238, second small gaps 240 and third small gaps 239. First small gap 238 is defined between each fan inner gap edge 43 and partition edge 113 (as the uniform perpendicular distance therebetween). After experimentation, it has been discovered that an acceptable size for first small gap 238 is ¼ inch, although other sizes (smaller or larger) would also function. Second small gap 240 is defined between fan rear gap edge 250 for each fan blade 28 and the chamber partition rear side 213. Third small gap 239 is defined between fan front gap edge 255 for each fan blade 28 and the chamber partition front side 216.

Figure 4:
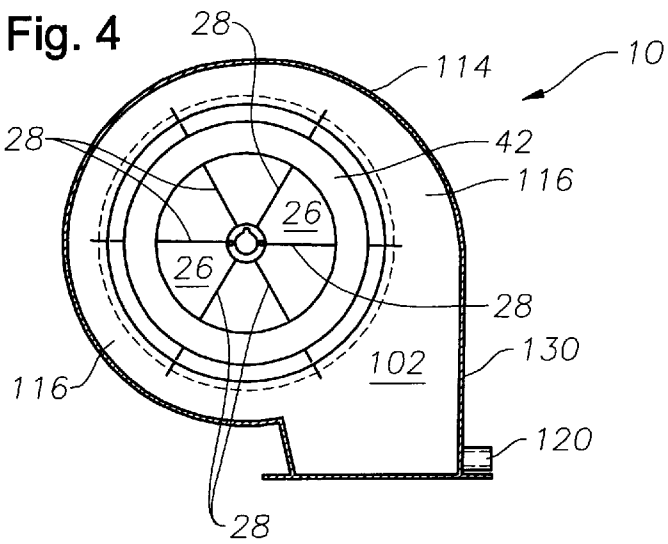
FIG. 4 is a cross-sectional view taken along line 4—4 of FIG. 2.
Figure 5:
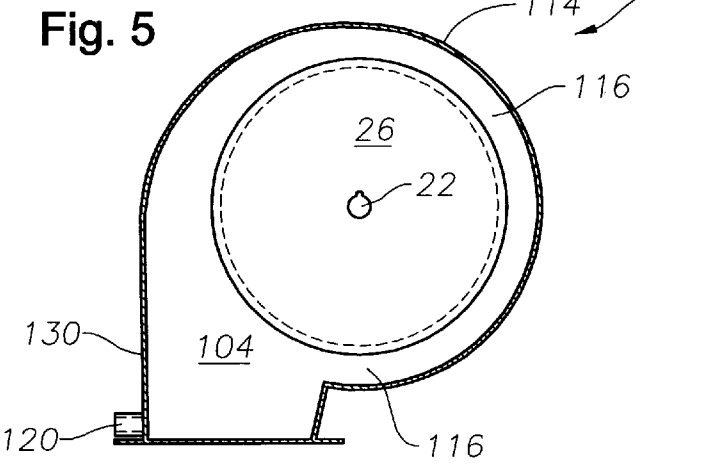
FIG. 5 is a cross-sectional view taken along line 5—5 of FIG. 2.
Figure 1:
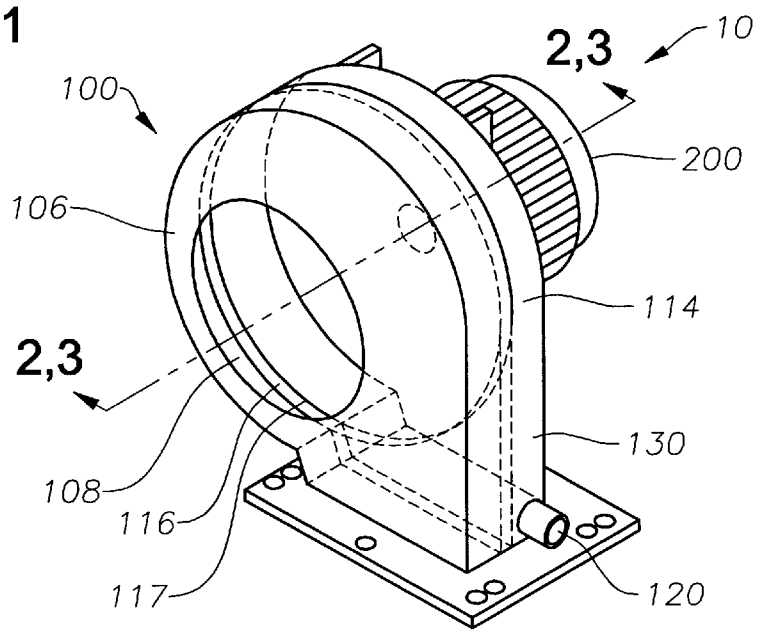
FIG. 1 is an isometric view of the extracting blower, not including the fan.
Figure 6:
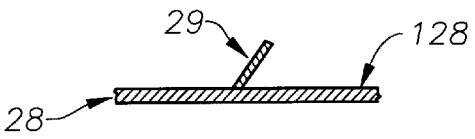
FIG. 6 is a cross-sectional view of a fan wiper shown in FIG. 3.

As depicted in FIG. 3 and FIG. 6, a wiper 29, comprising a polygonal, preferably rectangular, cross section and attached to each fan blade 28, is oriented normal to back plate 26 and on a bias to fan blade leading surface 128 of fan blade 28. Wiper 29 is positioned from rear gap corner 35 to front blade corner 33, such that wiper 29 does not interpose fan blade notch 217, and extends aligned with blade front edge 41. Wiper 29 has a preferred thickness in the range of ⅛ to ¼ inch and a preferred height of ½ inch, although smaller or larger heights are functional. As contaminants strike fan blade leading surface 128 and migrate toward fan blade outer edge 30, they are assisted in their directional movement towards rear chamber 104 via back plate 26 by the channeling effect of wiper 29.

In one embodiment as shown in FIG. 2, fan 20 also includes a front ring 42 attached to the end of each fan blade 28 distal back plate 26. Front ring 42, or like structures, are known in the art, and is preferably shaped so that its outer cross-sectional diameter is smaller than the cross-sectional diameter of the air intake opening 108 of front wall 110.

In the embodiment of housing 100 including tangential section 130, tangential section 130 is oriented so that it is tangential to the rotational direction of fan 20.

In one embodiment as shown in FIG. 2, housing 100 also includes an annular baffle 140. Annular baffle 140 is fixedly attached to the circumference of the air intake opening 108 and is constructed and oriented so that it directs air towards the interior of housing 100, specifically, front chamber 102.

In Operation

In operation, the motor 200 of extracting blower 10 is first activated. Activation of motor 200 induces drive means for rotation of rotor drive shaft 22 which in turn induces the rotation of fan 20. The rotation of fan 20 creates a suction or negative pressure through air intake opening 108, which prompts supply air (Dirty Air) surrounding the front exterior of housing 100 to enter housing 100 through air intake opening 108.

As previously disclosed, Dirty Air encompasses air that includes liquid and solid particles, and Clean Air encompasses air excluding at least some of such liquid and solid particles. As is well known in the art, it is understood that the heaviest components of Dirty Air are the liquid and solid particles included therein.

The Dirty Air entering housing 100 through air intake opening 108 enters front chamber 102 at a relatively high velocity, which high velocity is generated by the suction and also by annular baffle 140 (in the embodiment including the same). Such high velocity partly ensures that the heavier liquid and solid particles of Dirty Air strike the back plate 26 of fan 20 whereas the lighter air particles of Dirty Air are substantially diverted from striking the back plate 26 of fan 20 by the rotational motion of the fan blades 28.

The heavier liquid and solid particles of Dirty Air thus enter front chamber 102 at a high velocity and strike back plate 26. The rotational motion of fan 20, as is known in the art, circulates the air and generates a centrifugal force which forces elements radially outward from fan 20 and back plate 26. Thus, the centrifugal force causes the heavier liquid and solid particles of Dirty Air, together with a limited and regulated amount of the lighter air particles, to migrate along back plate 26 in a direction radially outward from fan 20. Ultimately and due to the existence of first small gap 38 as well as the location of back plate 26 within rear chamber 104, the migrating heavier liquid and solid particles of Dirty Air (together with a limited and regulated amount of the lighter air particles) pass through second small gap 40 (or fan blade notch 217 in the preferred embodiment) and enter rear chamber 104.

The lighter air particles of Dirty Air (or Clean Air) also enter front chamber 102 at a high velocity; however, due to their relatively lighter weight, are substantially diverted from striking back plate 26 by the rotational motion of the fan blades 28. The rotating fan blades 28, instead, direct the Clean Air tangentially outward within front chamber 102 and exhausts the Clean Air out of housing 100 through front chamber clean air outlet 118. Clean Air exiting front chamber clean air outlet 118 is thus free of contaminants and can be used as a source for relatively clean cooling air.

The heavier liquid and solid particles of Dirty Air (together with a limited and regulated amount of the lighter air particles) that have now entered rear chamber 104 through second small gap 40 next exit rear chamber 104 through rear chamber contaminant exhaust outlet 120. This egress is, at least in part, caused by the differential in pressure between the front chamber 102 and the rear chamber 104. Due to, among other things, the rotation of fan 20, the greater amount of Clean Air within front chamber 102, and the small sizes of first small gap 38 and second small gap 40, the pressure within front chamber 102 is substantially higher than the pressure within rear chamber 104. This difference in pressure acts to exhaust any elements located within rear chamber 104 out through rear chamber contaminant exhaust outlet 120. Thus, the heavier liquid and solid particles of Dirty Air (together with a limited and regulated amount of the lighter air particles) located within rear chamber 104 exit rear chamber 104 through rear chamber contaminant exhaust outlet 120. Such elements exiting through rear chamber contaminant exhaust outlet 120 may be transmitted to a waste disposal site or used for other suitable purposes.

It is noted that the difference in pressure between front chamber 102 and rear chamber 104 can be controlled and adjusted by changing the dimensions of, among other elements, front chamber clean air outlet 118, rear chamber contaminant exhaust outlet 120, first small gap 38, and second small gap 40. It is also noted that the difference in pressure between front chamber 102 and rear chamber 104 is important in order to ensure that the heavier liquid and solid particles of Dirty Air (together with a limited and regulated amount of the lighter air particles) do migrate through second small gap 40 (or fan blade notch 217 in the preferred embodiment) and into rear chamber 104 instead of remaining within front chamber 102.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. An extracting blower, comprising:

a fan housing;

said fan housing including a front wall, a rear wall and a side wall;

a rotatable fan located within said fan housing;

rotating means for rotating said fan;

an air intake opening in said housing front wall;

a partition provided in said fan housing intermediate said housing front wall and said housing rear wall;

said partition partially defining a housing front chamber and a housing rear chamber;

said partition including a partition opening;

a clean air outlet provided in said housing front chamber;

a contaminant exhaust outlet provided in said housing rear chamber;

said fan including a back plate oriented within said housing rear chamber;

a plurality of fan blades extending through said partition opening from said back plate toward said housing front wall;

each of said plurality of fan blades extending partially within said housing front chamber and partially within said housing rear chamber;

said back plate constituting a partial barrier between said housing front chamber and said housing rear chamber;

said partition opening being generally circular and concentric with said rotatable fan;

said fan blades extending radially outward from a fan axis of said fan, a fan blade rear section proximate said fan back plate;

a fan blade front section distal said fan back plate;

said fan blade rear section oriented within said housing rear chamber;

said fan blade front section oriented within said housing front chamber;

each of said plurality of fan blades having a fan blade outer edge;

said fan blade outer edges defining a fan blade diameter;

said fan blade diameter greater than said partition opening's diameter;

said plurality of fan blades provided with a fan blade notch in each of said fan blade outer edges;

said partition opening having a partition edge;

said fan blade notches arranged in relation to said partition so that said partition edge extends within said fan blade notches;

each of said fan blades having a leading surface, said leading surface being oriented in the direction of fan rotation;

a wiper provided on each of said fan blades;

each said wiper affixed to said leading surface of each of said fan blades; and said wiper being oriented on a bias to said fan blade leading surface such that said wiper does not interpose said fan blade notch and extends proximate said fan blade outer edge.

2. An extracting blower as in claim 1, further comprising:

said wiper having a first wiper end proximate said fan back plate;

said wiper having a second wiper end distal from said fan back plate;

said first wiper end terminating proximate said fan blade notch; and said second wiper end terminating proximate said fan blade outer edge.

3. A method of extracting particles from dirty air, said method comprising:

circulating said dirty air in a fan, said fan comprising a housing front chamber and a housing rear chamber, said front chamber and said rear chamber partially defined by a partition, said partition including a partition opening concentric with said fan, said fan comprising a plurality of fan blades oriented through said partition opening, said fan including a back plate, said back plate oriented in said housing rear chamber;

said circulating step including intaking said dirty air, said dirty air comprising clean air and contaminants, through an air intake opening and into said fan housing by means of said fan rotation, said fan rotation inducing an air velocity through said air intake;

separating said contaminants from said clean air;

said separating step including striking said back plate with said contaminants by means of said induced air velocity;

diverting said contaminants from said dirty air into said housing rear chamber by centrifugal migration of said contaminants along said back plate;

exhausting said diverted contaminants out a rear chamber contaminant exhaust outlet;

exhausting clean air out a front chamber clean air outlet;

each of said fan blades having a leading surface, said leading surface being oriented in the direction of fan rotation;

each of said plurality of fan blades having a fan blade outer edge;

each of said plurality of fan blades provided with a fan blade notch in each of said fan blade outer edges;

a wiper provided on each of said plurality of fan blades;

each said wiper affixed to said leading surface of each of said plurality of fan blades; and said wiper being oriented on a bias to said fan blade leading surface such that said wiper does not interpose said fan blade notch and extends proximate said fan blade outer edge.

4. A method of extracting particles from dirty air as in claim 3, wherein:

said wiper having a first wiper end proximate said fan back plate;

said wiper having a second wiper end distal from said fan back plate;

said wiper end terminating at said fan blade notch;

said second wiper end terminating at said fan blade outer edge.

* * * * *